United States Patent [19]

Walasewicz et al.

[11] 4,040,409

[45] Aug. 9, 1977

[54] GRINDING WHEEL TRUING MECHANISM

[75] Inventors: Stanley John Walasewicz, Cavendish; Virgil William Erickson; Robert Adams Harrison, both of Springfield; Royal Elwin Houghton, Ascutney, all of Vt.

[73] Assignee: Bryant Grinder Corporation, Springfield, Vt.

[21] Appl. No.: 642,417

[22] Filed: Dec. 19, 1975

[51] Int. Cl.[2] ..... B24B 53/06

[52] U.S. Cl. ..... 125/11 AS; 125/11 AT; 125/11 GA

[58] Field of Search ..... 125/11 R, 11 CC, 11 AT, 125/11 AS, 11 GA, 11 B, 11 BS

[56] References Cited

U.S. PATENT DOCUMENTS

| | | | |
|---|---|---|---|
| 2,335,341 | 11/1943 | Knowles | 125/11 GA |
| 2,366,623 | 1/1945 | Jakobsen | 125/11 AS |
| 2,614,552 | 10/1952 | Griffin | 125/11 AT |
| 3,167,064 | 1/1965 | Barnard | 125/11 AS |

FOREIGN PATENT DOCUMENTS

| | | | |
|---|---|---|---|
| 493,237 | 10/1938 | United Kingdom | 125/11 AS |

*Primary Examiner*—Harold D. Whitehead

*Attorney, Agent, or Firm*—James H. Bower; Mitchell J. Hill

[57] ABSTRACT

A multi-function grinding wheel truing mechanism that is capable of automatically imparting to the periphery of a grinding wheel either a combination radial and straight form, a radial form, a straight form, or a Gothic Arch form. A dresser unit housing swingably supports a turn post carrier which is normally biased to a first position by a spring. A turn post carrying a main diamond for dressing the periphery of a grinding wheel is rotatably supported on the turn post carrier. A single drive means is carried on the turn post carrier for moving the main diamond through a dressing path, and to accomplish all functions, including the automatic retraction of the main diamond at the end of the truing path and the automatic extension of the main diamond at the end of the return path. A cam means is operatively mounted on the turn post carrier for providing a combined rotary and swinging motion for moving the main diamond in a straight line dressing path, and for carrying out the dressing of a Gothic Arch form. A pair of side diamonds are provided for reducing the thickness of the grinding wheel during the time when the main diamond is imparting the form to the periphery of the grinding wheel.

4 Claims, 18 Drawing Figures

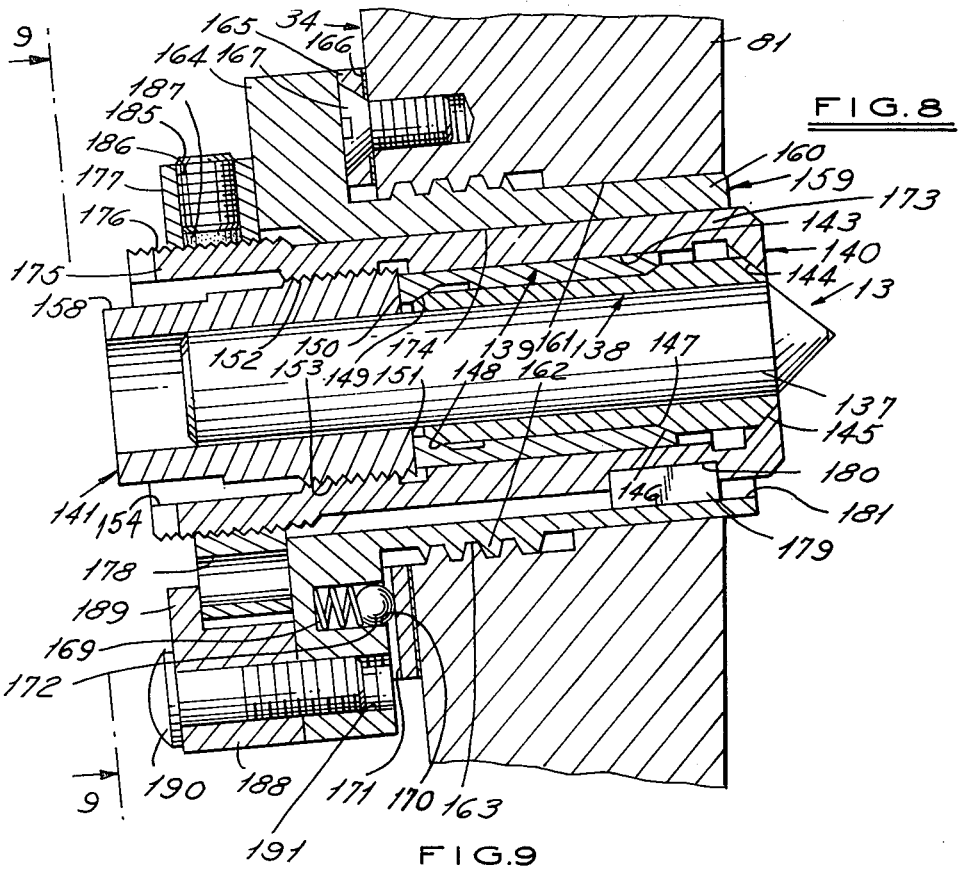
FIG. 8
FIG. 9
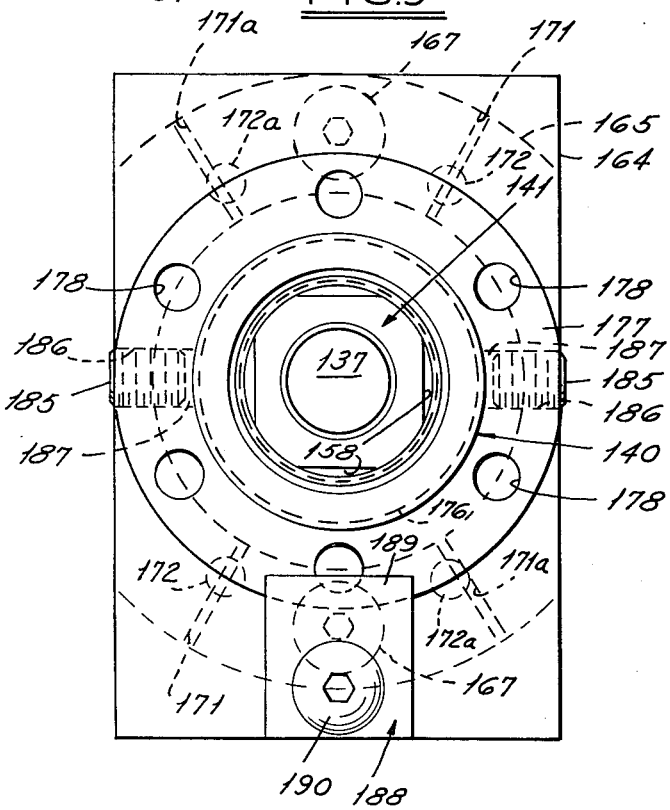

GRINDING WHEEL TRUING MECHANISM

SUMMARY OF THE INVENTION

This invention relates generally to truing mechanisms for dressing forms on the periphery of grinding wheels, and more particularly, to a multi-function grinding wheel dresser which is capable of automatically imparting to the periphery of a grinding wheel, either a combination radial and straight form, a radial form, a straight form, or a Gothic Arch form.

Heretofore, grinding wheel truing mechanisms have been provided which are capable of dressing both a radial and a straight line form, or a combination of the same. An example of such prior art grinding wheel truing mechanisms is shown in U.S. Pat. No. 3,167,064. A disadvantage of the dresser unit shown in the aforementioned patent is that it requires the entire dressing unit to be withdrawn to a retracted position during the return movement of the diamond, and such movements extend the length of time of a dressing operation. Another disadvantage of the dressing unit shown in said patent is that it is not capable of producing a Gothic Arch form which is desirable in some instances. Another disadvantage of the dresser unit shown in said patent is that it cannot include the function of side diamonds for reducing the thickness of a grinding wheel during the time when a main diamond is imparting a form to the periphery of a grinding wheel.

In view of the foregoing, it is an important object of the present invention to provide a novel and improved grinding wheel truing mechanism which is adapted to overcome the aforementioned disadvantages of the prior art grinding wheel truing mechanisms.

It is still another object of the present invention to provide a novel and improved grinding wheel truing mechanism which is constructed and arranged so as to isolate the turn post which carries the main diamond from forces originating in the driving means of the truing mechanism, whereby the accuracy of the form dressed on the periphery of a grinding wheel is improved.

It is another object of the present invention to provide a novel and improved grinding wheel truing mechanism which requires only one prime mover to accomplish all functions, including the automatic retraction of the main diamond at the end of the truing path, and the automatic extension of the main diamond at the end of the return path, and in which such retraction and extension movements of the main diamond are carried out without moving the entire truing mechanism so as to carry out a dressing operation automatically and in a minimum of time.

It is a further object of the present invention to provide a novel and improved grinding wheel truing mechanism which is capable of imparting to a grinding wheel either a combination radial and straight form, a radial form, a straight form, or a Gothic Arch form.

It is still a further object of the present invention to provide a novel and improved grinding wheel truing mechanism which is provided with a main diamond for dressing a form on the periphery of a grinding wheel, and which is provided with a pair of side diamonds for reducing the thickness of the grinding wheel during the time when the main diamond is imparting a form to the periphery of the grinding wheel.

It is still another object of the present invention to provide a grinding wheel truing mechanism for dressing forms on the periphery of a grinding wheel and which includes a support housing for mounting in a position adjacent the grinding wheel on which a form is to be imparted to the periphery of the grinding wheel, a turn post carrier having one end pivotally mounted on said housing, means for normally biasing the other end of said turn post carrier to an initial position, a turn post rotatably mounted on said turn post carrier, a main diamond mounted on said turn post for dressing forms on the periphery of a grinding wheel, and means for rotating said turn post and swinging said turn post carrier from said initial position for advancing said main diamond from an initial position through a dressing path for dressing a form on the periphery of a grinding wheel and for retracting the main diamond to said initial position. At least one side diamond may be operatively mounted on the turn post carrier for reducing the thickness of a grinding wheel. The main diamond is operatively mounted on the turn post for retracting the main diamond when it is at the end of a dressing path, and for extending the main diamond after it has been returned to the start of a dressing path.

Other objects, features and advantages of this invention will be apparent from the following detailed description, appended claims, and the accompanying drawings.

BRIEF DESCRIPTION OF THE DRAWINGS

FIG. 8 is a fragmentary, enlarged, elevation section view of the diamond holder structure illustrated in FIG. 5, taken along the line 8—8 thereof, and looking in the direction of the arrows.

FIG. 9 is a left side elevation view of the diamond holder structure illustrated in FIG. 8, taken along the line 9—9 thereof, and looking in the direction of the arrows.

DESCRIPTION OF THE PREFERRED EMBODIMENTS

General Dresser Construction

Figure 1:
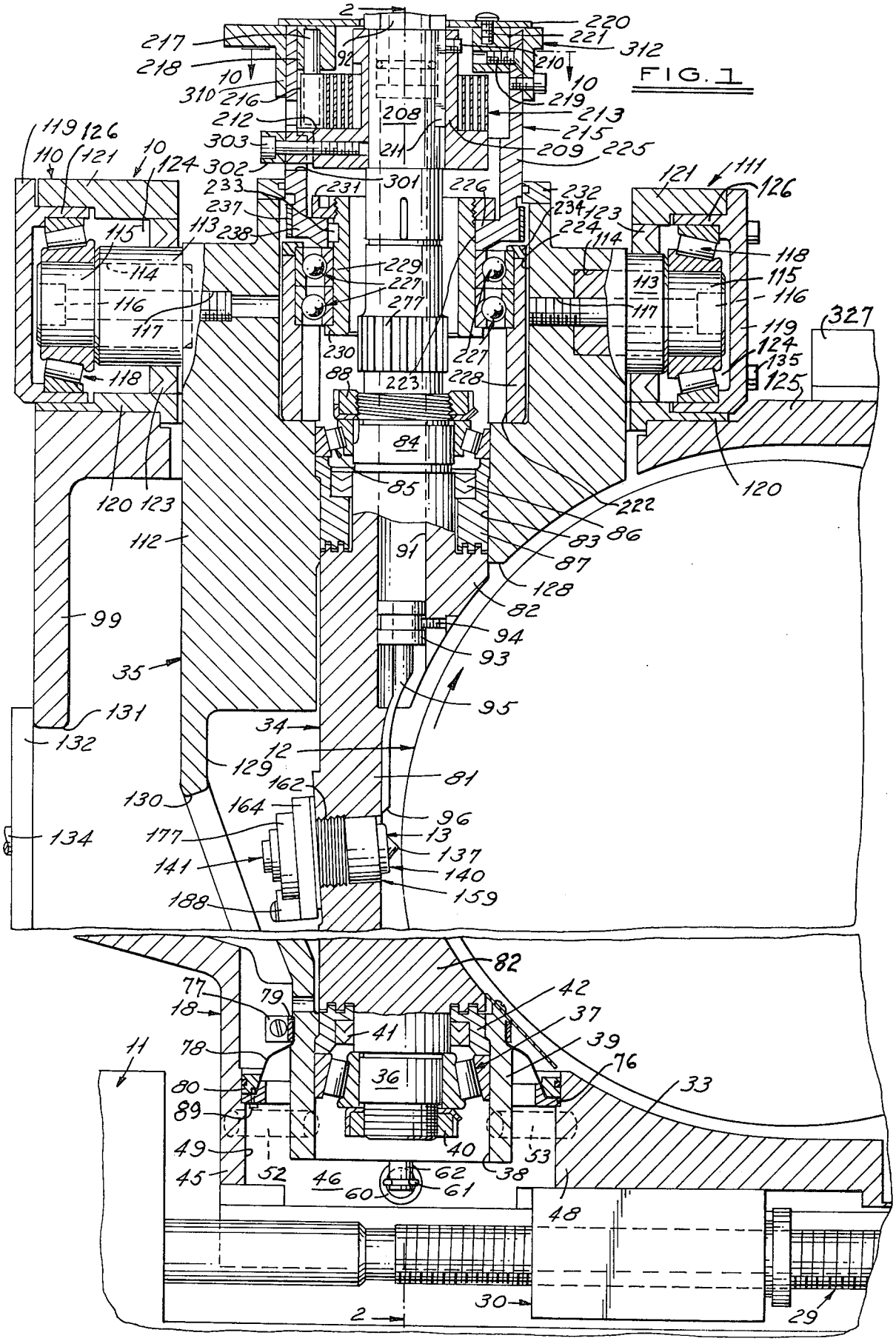
FIG. 1 is a broken, elevation section view, with parts broken away, of a grinding wheel truing mechanism made in accordance with the principles of the present invention, taken along the line 1—1 of FIG. 2, and looking in the direction of the arrows.
Figure 2:
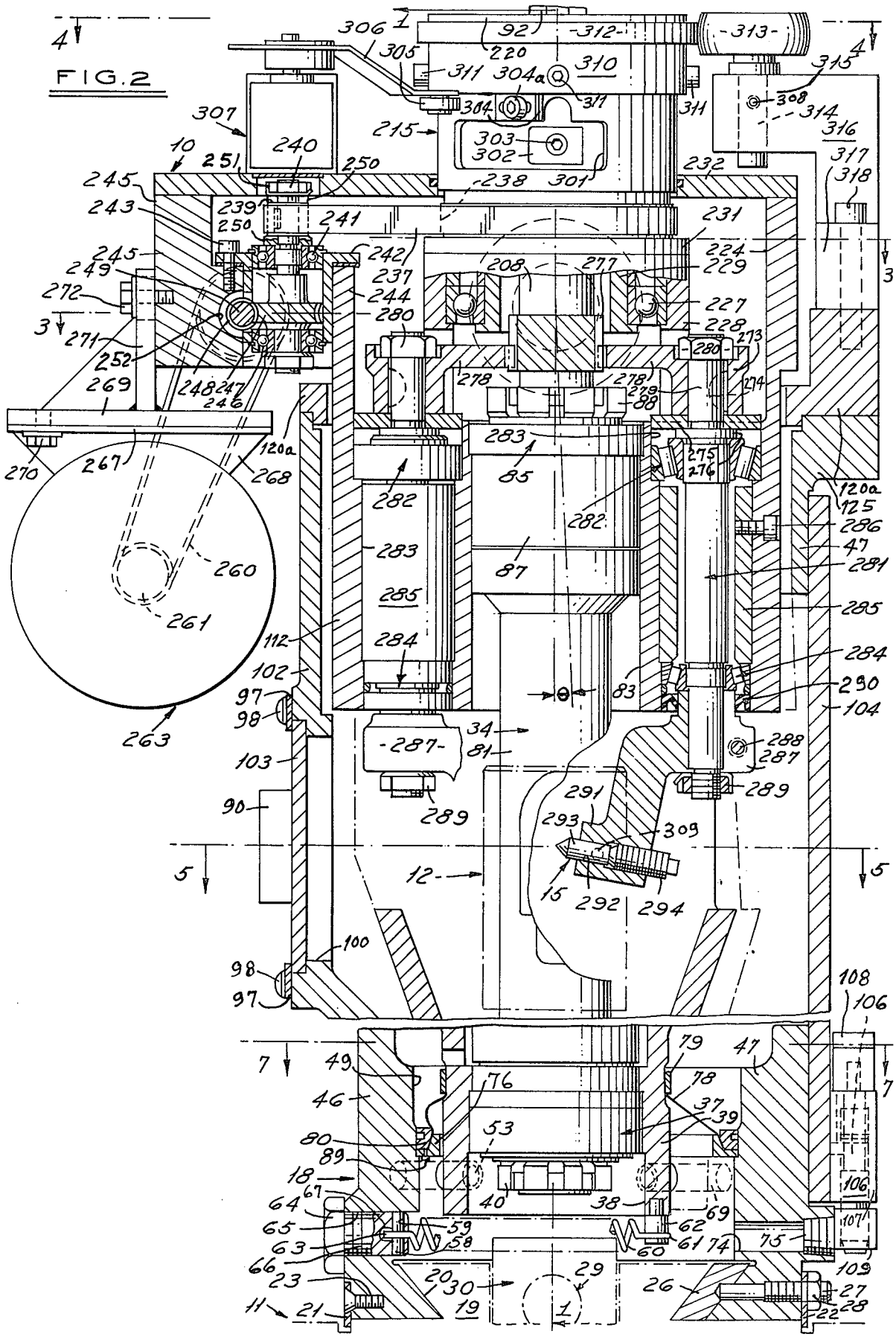
FIG. 2 is a broken, elevation section view, with parts broken away, of the grinding wheel truing mechanism illustrated in FIG. 1, taken along the line 2—2 thereof, and looking in the direction of the arrows.

Referring now to the drawings, and in particular to FIG. 1, the numeral 10 generally designates a grinding wheel dresser unit made in accordance with the principles of the present invention. The numeral 11 generally designates a fragmentary portion of the support base of a conventional precision grinding machine which is provided with a grinding wheel, generally indicated by the numeral 12, that is to be dressed by the dressing unit 10. The dresser unit 10 is adjustably mounted on the support base 11 of the grinding machine, as more fully described hereinafter in detail. The dresser unit 10 is provided with a main diamond means, generally indicated by the numeral 13 in FIG. 1, and in FIGS. 14 through 17, for radial and straight line dressing. The dresser unit 10 is further provided with a pair of side diamond means, generally indicated by the numerals 14 and 15 in FIGS. 14 through 17, for reducing the thickness of the grinding wheel 12 during the time when the main diamond means 13 is imparting a desired form to the periphery of the grinding wheel 12. The side diamond means 15 is also seen in FIG. 2. As described more fully hereinafter, the main diamond means 13 may be provided with selective types of movements for producing a combination radial and straight line form, or a Gothic Arch form, on the periphery of the grinding wheel 12.

Detailed Description of the Dresser Structure

As shown in FIGS. 1 and 2, the dresser unit 10 includes a support base 18 which is slidably and adjustably mounted on the grinding machine support base 11. The grinding machine support base 11 is provided with a suitable dovetail way 19, on which is slidably mounted the lower end 20 of the base 18. The base lower end 20 is formed as a slide with a recess having tapered sides that mate with the sides of the dovetail way 19. The slide 20 is provided on the back and front sides thereof with a side wiper strip, as 21 and 22, respectively, which is secured in place by any suitable means, as by screws 23. As shown in FIG. 2, the slide 20 is secured in an adjusted position on the dovetail way 19 by a longitudinally extended gib 26, and a plurality of suitable gib screws 27 and lock nuts 28. As shown in FIG. 1, the base 18 is adapted to be adjusted by an adjusting screw 29, which has one end rotatably mounted in the grinding machine base 11, and which is threadably mounted through an adjusting nut 30 that is secured to the underside of the base 18 by any suitable means, as by suitable machine screws (not shown). A suitable handle is carried on the other end of the screw 29 for rotating the same.

As shown in FIG. 1, the dresser unit 10 has an arcuate opening 33 on the right side thereof for the admission of the grinding wheel 12. The numeral 34 generally designates a turn post or shaft on which is operatively mounted the main diamond means 13. The turn post 34 is rotatably mounted in a turn housing or post carrier, generally indicated by the numeral 35.

As shown in FIG. 1, the numeral 38 designates the reduced diameter lower cylindrical portion 82 of the turn post 34, and it is rotatably mounted in a suitable tapered roller bearing means, generally indicated by the numeral 37.

The bearing means 37 is operatively mounted in a cylindrical bore or chamber 38 that is formed in the lower end 39 of the post carrier 35. The tapered bearing means 37 is retained in position in the lower end of the turn post carrier portion 39 by any suitable means, as by a retainer nut 40. A suitable seal means 41 is operatively mounted around the turn post portion 36, in a position immediately above the tapered bearing means 37. The seal means 41 is held in an operative position by a suitable annular seal retainer 42.

Figure 7:
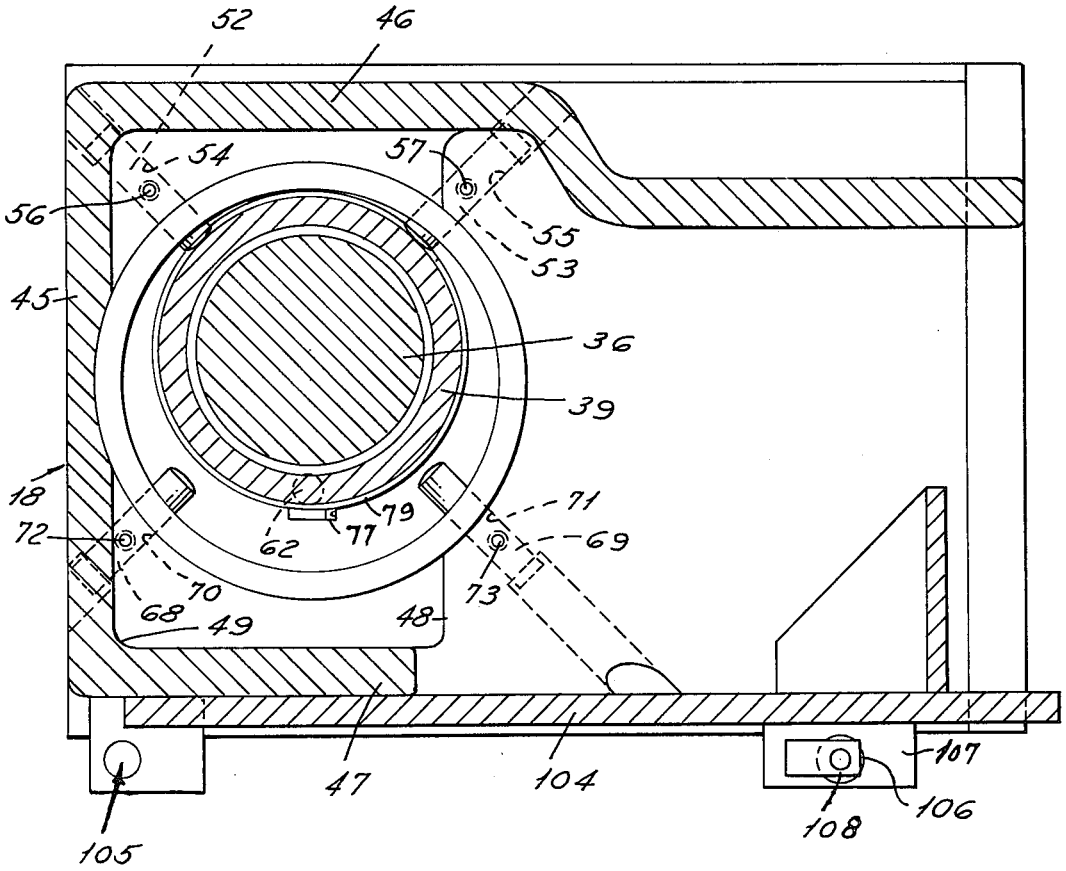
FIG. 7 is a horizontal section view of the structure illustrated in FIG. 2, taken along the line 7—7 thereof, and looking in the direction of the arrows.

As best seen in FIG. 7, the base 18 is provided with an integral left side wall 45, a back wall 46, a front wall 47, and a right side wall 48. A chamber 49 is formed in the base 18 within the last mentioned four walls. As shown in FIG. 1, the lower cylindrical end 39 of the post carrier 35 extends down into the last mentioned chamber 49, and it is normally biased into the position shown in FIG. 7 by a coil spring 60. The coil spring 60 has one end 61 secured to a retainer pin 62 that is fixed to the lower end of the post carrier lower end portion 39. The other end 63 of the spring 60 is mounted around a pin 58 which is mounted transversely through a bore 59 formed through the inner end of an adjusting screw 66. The inner end of the adjusting screw 66 is also provided with a longitudinally extended slot 67 into which is seated the spring end 63. The tension of the spring 60 may be adjusted by threading the adjusting screw 66 inwardly and outwardly in the threaded bore 65. The adjusting screw 66 is secured in an adjusted position by a suitable lock nut 64. As seen in FIG. 7, the spring 60 normally retains the lower end 39 of the post carrier 35 against two horizontally disposed set screws 52 and 53. The set screws 52 and 53 are adjustably mounted in threaded bores 54 and 55 so as to be disposed on axis spaced 90° radially apart. The set screws 52 and 53 are held in desired adjusted positions by any suitable means, as by the lock screws 56 and 57, respectively. The spring 60 retains the turn post 34 and the post carrier 35 in the position shown in FIG. 7 when the dresser unit is dressing a radial form or the first half of a Gothic Arch.

As shown in FIG. 7, a second pair of set screws 68 and 69 are operatively mounted in the base 18, in positions diametrically opposite to the set screws 53 and 52, respectively. The set screws 68 and 69 are threadably mounted in threaded bores 70 and 71, respectively, which are formed in the base 18, and they are held in desired adjusted positions by the lock screws 72 and 73 respectively. The turn post 34 and the post carrier 35 are swung over, so as to engage the lower end 39 of the post carrier 35 with the set screws 68 and 69 when the dresser unit dresses the second half of a Gothic Arch form, as described in detail hereinafter. As shown in FIG. 2, the chamber 49 is provided with a suitable drain passage 74, which is enclosed at its outer end by a suitable threaded plug 75.

As best seen in FIG. 2, the chamber 49 in the base 18 is protected against the swarf, or the dirt caused by a dressing operation, by a suitable bellows type flexible sleeve cover 78 which is operatively mounted around the lower end 39 of the post carrier 35. The upper end of the sleeve cover 78 is retained against the post carrier lower end 39 by a suitable circular retainer ring 79 which has its ends held together by a screw 77, as shown in FIG. 7. As shown in FIG. 2, the lower end of the flexible sleeve cover 78 is secured to the wall of the chamber 49 by a suitable circular seal 80 which is retained in place by an annular seal retainer 76 and screws 89. As shown in FIG. 1, the turn post or turn shaft 34 includes the lower cylindrical portion 82 which is integral with the lower end portion 36, and a central reduced portion 81 which is substantially rectangular in cross section. The upper end of the turn post central portion 81 is integrally connected to an upper cylindrical portion 82 which is rotatably mounted in a vertical bore 83 formed through the upper end portion 112 of the post carrier 35.

As shown in FIG. 1, the turn post or turn shaft 34 has a reduced diameter shaft 84 integrally connected to the upper end of the upper cylindrical portion 82. The shaft portion 84 is rotatably mounted in a suitable tapered thrust bearing means, generally indicated by the numeral 85, which has its outer race seated on the upper end of an annular seal retainer 87 in the bore 83. The seal retainer 87 carries a suitable annular seal means 86 which is disposed around the shaft portion 84. The inner race of the roller bearing means 85 is secured in position by a suitable lock nut 88, which is threadably mounted on the shaft 84. A longitudinally extended bore or passage 91 is formed through the turn post 34. A suitable coolant coupling 92 is operatively mounted in the upper end of the passage 91 for connection to a suitable source of coolant under pressure. The lower end of the passage 91 is enclosed by a suitable plug 93 which is secured in place by a lock screw 94. A coolant supply tube 95 has its upper end operatively mounted through the plug 93 so as to receive coolant from the passage 91. The lower end 96 of the coolant supply tube 95 is open, and it is disposed immediately above the main diamond means 13 for a selective supply of coolant under pressure to the main diamond 13 during a dressing operation.

Figure 5:
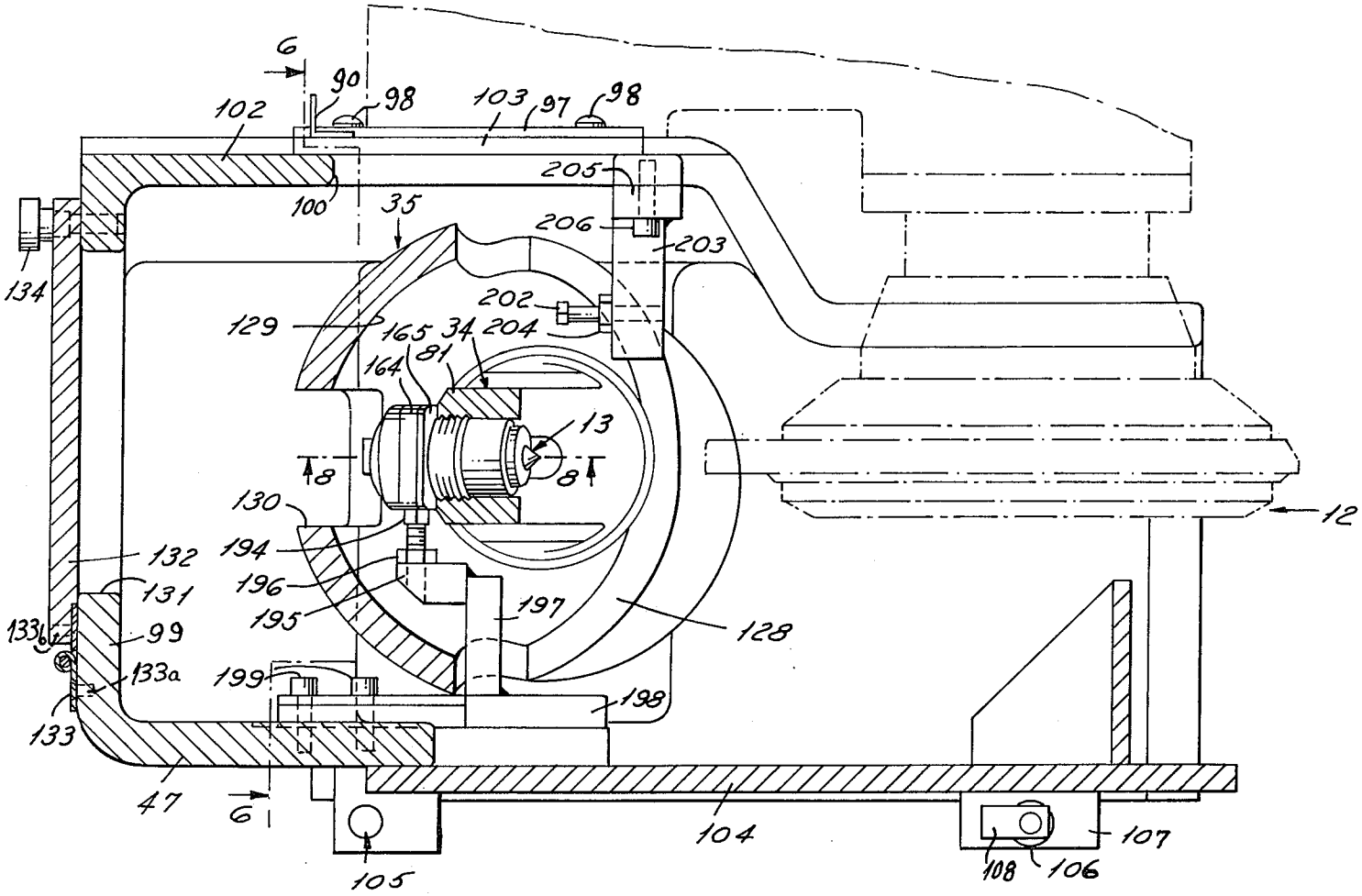
FIG. 5 is a fragmentary, horizontal section view of the grinding wheel truing mechanism illustrated in FIG. 2, taken along the line 5—5 thereof, and looking in the direction of the arrows.
Figure 6:
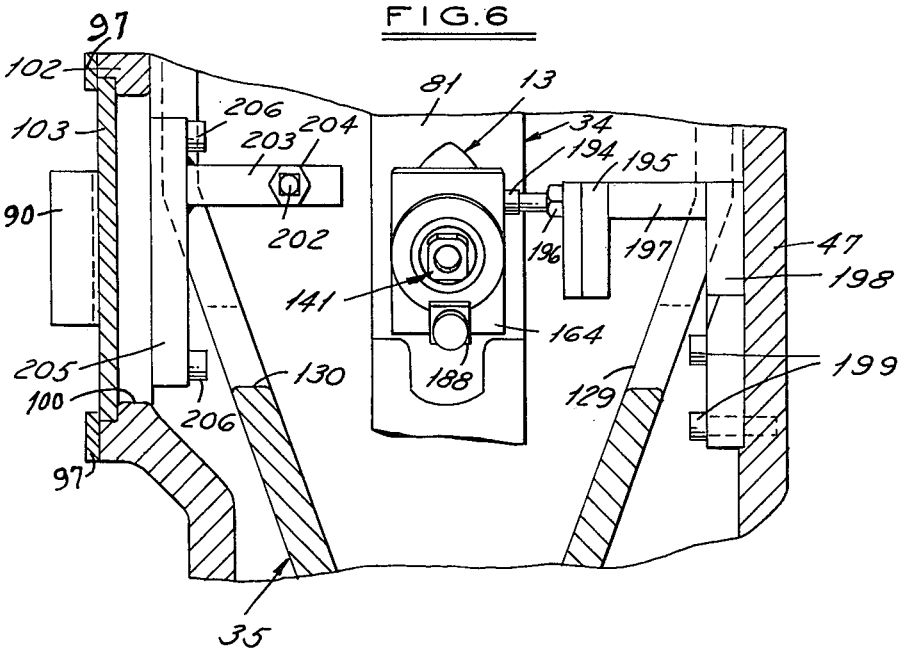
FIG. 6 is a fragmentary, vertical section view of the structure illustrated in FIG. 5, taken along the line 6—6 thereof, and looking in the direction of the arrows.

As shown in FIG. 1, the base left side wall 45 is extended upwardly, and it is offset outwardly, and it is designated by the numeral 99. The back wall 46 is extended integrally upwardly, and the upper end thereof is designated by the numeral 102 in FIGS. 2 and 5. An opening 100 is formed through the back wall 102, and it is enclosed by a sliding door 103. As best seen in FIGS. 2, 5 and 6, the sliding door 103 is held in position by a pair of guide bars 97 which are each secured in place by a pair of machine screws 98. The sliding door 103 is provided with a suitable handle 90 for operating the same.

As shown in FIGS. 2, 5 and 7, the dresser unit 10 is provided with a hinged front door 104. The left side of the door 104 is hingedly mounted on the base front wall 47 by any suitable means, as by a pair of suitable hinge means generally indicated by the numeral 105. As best seen in FIG. 2, the right side of the door 104 is releasably secured to the base front wall 47 by a slidably mounted plunger bolt 106 which is carried in a plunger block 107 that is fixed to the door 104. The plunger bolt 106 is provided with a suitable handle knob 108. In order to open the door 104, the handle knob 108 is manually moved upwardly to release the lower end of the plunger bolt 106 from a plunger clamp block 109 that is fixed on the outer side of the base wall 47.

As shown in FIG. 1, the upper end 112 of the turn post carrier 35 is provided with a pair of outwardly extended, diametrically disposed pivot shafts 113 which are rotatably supported in a pair of left side and right side trunnion housings, generally indicated by the numerals 110 and 111, respectively. Each of the pivot shafts 113 is pivotally mounted in its respective trunnion housing 110 and 111 by a trunnion journal 115. Each of the trunnion journals 115 has the inner end thereof mounted in an axial bore 114 formed in the adjacent pivot shaft 113. The trunnion journals 115 are each secured in place by a suitable machine screw 116 which extends through the trunnion journal and is threadably mounted in a threaded bore 117 formed in the turn post carrier upper end 112.

Figure 4:
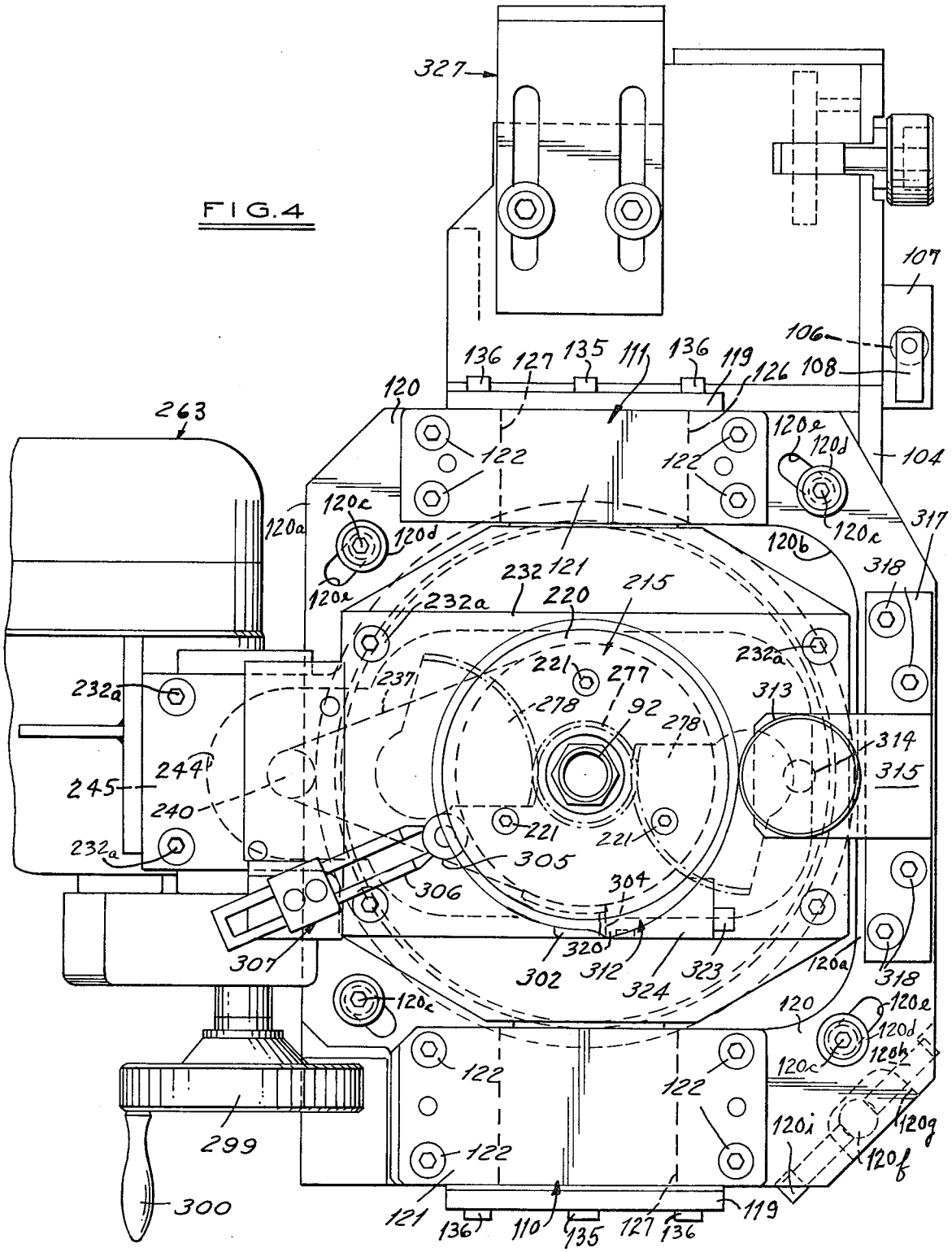
FIG. 4 is a fragmentary, top plan view of the grinding wheel truing mechanism illustrated in FIG. 2, taken along the line 4—4 thereof, and looking in the direction of the arrows.

As shown in FIG. 1, each of the trunnion journals 115 is rotatably supported on a suitable tapered bearing means, generally indicated by the numeral 118. The outer race of each of the tapered trunnion bearing means 118 is operatively supported by a horizontally disposed annular support member 126 which is integrally attached at its outer end to a vertically disposed support plate 119. The bearing support member 126 is seated in a recess 127 which is formed in a carrier frame transverse member 120. Each of the support plates 119 is secured to its respective carrier frame transverse member 120 by a suitable machine screw 135 (FIG. 4). The top and sides of each of the bearing means 118 are enclosed by a suitable U-shaped cover 121 which is secured to its respective frame member 120 by suitable machine screws 122. As shown in FIG. 1, an annular seal 123 is mounted within the cover 121 and it is held in an operative position around the adjacent pivot shaft 113. The support plate 119 is also attached to the vertical legs of the U-shaped cover 121 by machine screws 136.

The tapered trunnion bearing carrier frame includes the two transverse side frame members 120 and a pair of longitudinally extended front and back frame members **120*a*. The trunnion bearing carrier frame includes an inner opening 120*b* in which is disposed the upper end 112 of the turn post carrier 35. The trunnion bearing carrier frame is adapted to be arcuately or circularly adjustable on the top of the dresser unit housing to permit circular adjustment of the tapered trunnion bearing housings 110 and 111 about the vertical axis of the turn post carrier 35. The trunnion bearing carrier frame is adapted to be secured in place on top of the dresser unit housing by a plurality of machine screws 120*c* and washers 120*d*. As shown in FIG. 4, each of the machine screws 120*c* extend down through an elongated slot 120*e* to permit circular adjustment of the trunnion bearing carrier frame relative to the dresser unit housing. As shown in FIG. 4, adjustment of the trunnion bearing carrier frame is carried out by a pair of adjustment screws 120***h* and 120*i* which are horizontally mounted in suitable threaded holes in one corner of said carrier frame, and which have their inner ends extended into a recess 120*g* in said carrier frame. Extending upwardly from the dresser unit housing is a fixed stud 120 against which the inner ends of the adjusting screws 120*h* and 120*i* are engaged. It will be seen, that by backing off on one of the last mentioned adjustment screws and moving the other forward, the tapered trunnion bearing carrier frame may be circularly adjusted about the turn post carrier 35 to a desired adjusted position.

As shown in FIG. 1, the right side of the turn post carrier 35 is provided with an opening 128 for exposing the turn post shaft 34 to the grinding wheel 12 which is to be dressed. The turn post carrier 35 is provided with a chamber 129, in a central portion thereof, in which the main diamond means 13 is disposed. An access opening 130 is formed in the left side of the turn post carrier 35 for access into the chamber 129 and to the main diamond means 13. The left side wall 99 of the dresser unit housing is also provided with an access opening 131 which is enclosed by a hingedly mounted door 132. As shown in FIG. 5, the door 132 is hingedly mounted on one side by suitable strip hinge 133, which is secured to the dressed unit housing wall 99 by suitable screws 133*a* and to the door 132 by suitable screws 133*b*. The door 132 is adapted to be releasably secured in a closed position by a suitable thumb screw 134.

The main diamond means 13 is shown mounted in an operative position in the turn post 34 in FIG. 1, and a cross section of the same is shown in FIG. 8. As shown in FIG. 8, the main diamond means 13 includes a conventional diamond bar 137 which is mounted in the bore of a tubular male collet, generally indicated by the numeral 138. The male collet 138 is mounted within a tubular female collet, generally indicated by the numeral 139, which in turn is carried in a main diamond holder body, generally indicated by the numeral 140. The diamond bar 137 is locked in a desired adjusted position by a suitable locking plug, generally indicated by the numeral 141.

As shown in FIG. 8, the main diamond holder body 140 includes a tubular body portion 173 which has a front end wall that has a tapered inner end surface 144, and through which is formed a hole that protrudes the pointed end of the diamond bar 137. The male collet 138 has a tapered external front shoulder 145 which is adapted to be seated on the tapered inner front wall surface 144 of the main holder body portion 173. The male collet 138 is also provided with an intermediate external tapered shoulder 146 which seats against the tapered internal front end shoulder 147 that is formed on the female collet 139. The male collet 138 is provided with a tapered external rear shoulder 148 which is seated on a tapered internal shoulder 149 formed at the rear end of the female collet 139. The rear end 150 of the female collet 139 is formed perpendicular to the longitudinal axis of the tubular female collet 139 and is seated against the front end 151 of the locking plug 141.

As shown in FIG. 8, the bore 143 in the tubular body portion 173 of the main diamond holder body 140 is provided with an internal thread 152 which receives the threaded front end portion 153 of the locking plug 141. The bore 143 in the holder body 140 is enlarged at the rear end thereof, as indicated by the numeral 154. The rear end of the locking plug 141 extends outwardly of the rear end of the holder body 173 and is provided with wrench flats 158 for selective turning of the locking plug 141.

The main bearing holder body 140 is slidably mounted for longitudinal adjustment thereof in the bore 174 of the elongated tubular body 160 of a diamond holder housing, generally indicated by the numeral 159. The diamond holder housing 159 includes a tubular sleeve 160 which is rotatably mounted in a bore 161 formed through the central portion 81 of the turn post 34. The rear end of the housing sleeve 160 is provided with a suitable thread 162 as an Acme thread, for meshing engagement with a mating Acme thread 163 formed in the rear end of the bore 161 in the turn post 34. Integrally formed on the rear end of the diamond holder housing sleeve 160 is a rectangular flange 164 which is seated against the outer face of a detent plate 165. The detent plate 165 is secured to the rear face of the turn post 34 by a pair of suitable machine screws 167 (FIG. 9). A shim 166 is mounted between the detent plate 165 and the turn post 34, for clearance and alignment purposes.

As shown in FIG. 9, a first set of diametrically disposed detent balls 172 is adapted to be operatively carried in the inner face of the diamond holder flange 164, and they are normally seated in a pair of mating detent grooves 171 formed on the outer face of the detect plate 165 when the main diamond assembly 13 is in the dressing position. As shown in FIG. 8, each of the detent balls 172 is operatively mounted in a longitudinally extended detent bore 170 formed on the inner face of the flange 164. A detent spring 169 is mounted in each bore 170 for normally biasing the respective detent ball 172 outwardly into engagement with the adjacent detent slot 171. As shown in FIG. 9, a second set of detent balls 172*a* is similarly mounted in the inner face of the flange 164, and they are normally not seated in a second set of detent slots 171*a* when the flange 164 is in the dressing position shown in FIGS. 5 and 9.

As best seen in FIG. 8, the rear end of the diamond holder housing tubular body 173 is enlarged in diameter, as indicated by the numeral 175, and the outer periphery thereof is provided with a suitable thread 176. An adjusting collar 177, shown in FIGS. 8 and 9, is threadably mounted on the threaded rear end 175 of the tubular housing 173, and it is provided with suitable wrench openings 178 for adjusting said collar. The collar 177 is adapted to be maintained in a desired adjusted postion by a pair of suitable set screws 185 (FIG. 9) which are threadably mounted in threaded bores 186 formed in the periphery of the adjusting collar 177, and at diametrically opposite positions. A suitable soft, locking material 187, as a plastic or soft metal, is disposed on the inner end of each of the lock screws 185 for engagement with the thread 176 to provide a locking action without damaging the thread 176. As shown in FIG. 8, a round-ended key 179 is seated in a slot 180, formed on the lower outer periphery of the main diamond holder body 140, and it is slidably mounted in a longitudinally extended key slot 181 formed in the inner periphery of bore 174 in the diamond holder housing sleeve 160.

It will be seen that the diamond bar 137 is adapted to be loaded and locked in an adjusted position in the main diamond holder body 140 by first removing the locking plug 141 and then inserting the diamond bar 137 and moving it forwardly to a desired position. The locking plug 141 is then replaced and threaded inwardly so as to move the female collet 139 forward into locking engagement with the male collet 138 which in turn grips the diamond bar 137, and holds it in position in the main diamond holder body 140. The main diamond holder body 140 may be axially adjusted by releasing the lock screws 185, and clamp 188, and rotating the adjusting collar 177 in the appropriate direction so as to move the main diamond holder body 140 axially in a desired direction. The key 179 functions to convert the rotary action of the collar 177 into linear movement of the main diamond holder body 140. After the last mentioned adjustment has been effected, the lock screws 185 are again screwed inwardly to lock the collar 177 in position relative to the main diamond holder body 140. The adjusting collar 177 is then clamped to the flange 164 by means of the clamp 188 which has an inwardly directed finger 189 that engages the outer face of the adjusting collar 177. The clamp 188 is secured by a suitable machine screw 190 in place. The machine screw 190 has its inner end threadably mounted in a suitable thread bore 191 formed in the flange 164.

FIGS. 5, 6 and 9 show the position of the main diamond means 13 when it is performing a dressing operation on the periphery of the diamond wheel 12. The position shown in FIGS. 5, 6 and 9 is at a point in the travel of the main diamond means 13 when it is at the end of a dressing operation and making engagement with a bumper or stop screw 194 for rotating the flange 164 to retract the main diamond means 13, to permit the turn post carrier 35 to be returned along the same path to its initial starting position. As shown in FIGS. 5 and 6, the bumper screw 194 is threadably mounted in a suitable mounting bar 195, and it is locked in an adjusted position by a lock nut 196. The mounting bar 195 is fixed on a mounting bar 197 which in turn is fixedly supported on a mounting bar 198 that is secured by suitable machine screws 199 to the housing wall 47.

As shown in FIG. 9, before the flange 164 bumps against the bumper screw 194, the detent balls 172 are positioned in their respective detent slots 171 for retaining the main diamond means 13 in the dressing position shown in FIG. 9. When the flange 164 is bumped against the bumper screw 194, it is provided with a counterclockwise rotation, as viewed in FIG. 9, so as to move the detent balls 172 out of their respective detent slots 171, and the detent balls **172*a* into their respective detent slots 171*a*. This rotation of the flange 164 also rotates the entire main diamond means 13 by action of the Acme threads 162 and 163, so as to withdraw the tip of the diamond bar 137 about 0.002 inch away from the periphery of the grinding wheel 12 on which it has just finished a dressing operation. The main diamond means 13 is then returned to its initial starting position as described in detail hereinafter, and when it has reached its inital position, the flange 164 will be bumped against a bumper screw 202, as shown in FIGS. 5 and 6. The flange 164 and the main diamond means 113 are rotated clockwise to the original position shown in FIG. 9, wherein the detent balls 172 are again in the detent slots 171 and the detent balls 172*a* have been moved out of their detent slots 171*a*. The main diamond means 13 is then ready for another dressing operation. As shown in FIGS. 5 and 6, the bumper screw 202 is threadably mounted in a mounting bar 203 and it is secured in an adjusted position by a lock nut 204. The mounting bar 203 is fixed to a mounting bar 205 which is secured by suitable machine screws 206 to the dresser housing wall 102. In one embodiment, the detent slots 171 and 171*a* were disposed at an angle of about 33⅓° from the center line axis of the plate 164, as viewed in FIG. 9**, and they were cut to a depth of about 0.04 inch in a V-groove shape of 120°.

Figure 10:
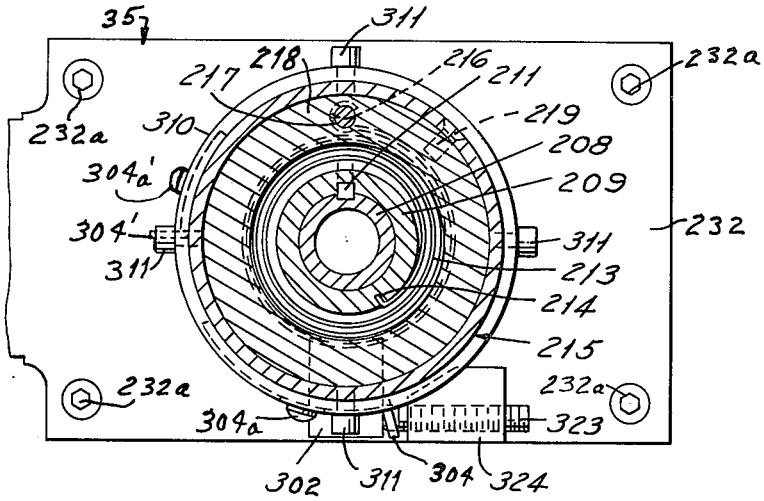
FIG. 10 is a horizontal section view of the structure illustrated in FIG. 1, taken along the line 10—10 thereof, and looking in the direction of the arrows.

The drive means for rotating the main diamond means 13 through a dressing operation is shown in FIGS. 1, 2, 4 and 10. As best seen in FIG. 1, the upper end of the turn post 34 is designated by the numeral 208, and it extends outwardly above the upper end 112 of the turn post carrier 35. A turn disc or sleeve 209 is fixedly mounted on the upper end 208 of the turn post 34 by a suitable lock screw 210 and key 211. Integrally formed on the lower end of the turn disc 209 is an outwardly extended flange 212 on which is operatively mounted a wind-up or clock spring, generally indicated by the numeral 213. The spring 213 is a coil spring which is wound-up when it is in the initial drive position shown in FIGS. 1 and 10. As shown in FIG. 10, one end 214 of the spring 213 is fixed to the turn disc 209, and the other end 216 of the spring 213 is fixed to a retainer pin 217 that is carried on an attachment ring 218. As shown in FIG. 1, the attachment ring 218 is fixed by a suitable screw 219 to the body 225 of a driven drum, generally indicated by the numeral 215. The driven drum 215 is mounted concentrically about the turn disc 209, and it is enclosed on the upper end thereof by a suitable circular cover 220 which is secured by suitable machine screws 221 (FIG. 4) to the upper end of the attachment ring 218.

Figure 3:
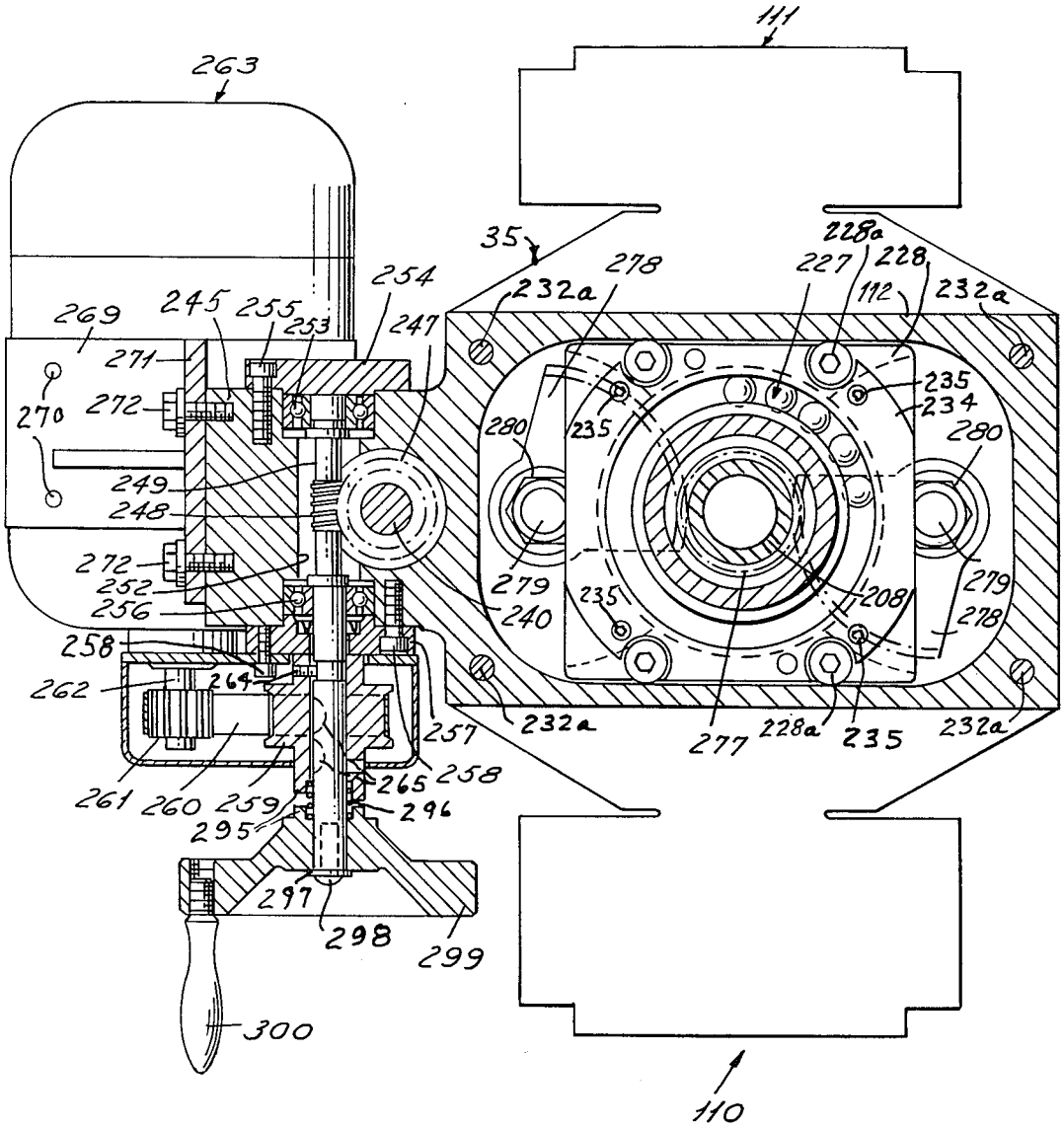
FIG. 3 is a horizontal section view of the grinding wheel truing mechanism illustrated in FIG. 2, taken along the line 3—3 thereof, and looking in the direction of the arrows.

The driven drum 215 is rotatably supported in the upper end 112 of the turn post carrier 35 by the following described structure. As shown in FIG. 1, the driven drum 215 includes the cylindrical body 225 which has a bottom wall 226 through which is formed a central bore 223. Mounted within the bore 223 is a bearing race support sleeve 229 which is adapted to support the inner race of a pair of suitable ball bearings 227 for rotatably supporting the driven drum 215 on the upper end of the turn post carrier 35. The outer races of the bearings 227 are operatively supported on a shoulder formed in the inner face of the surface of the central bore 222 in a bearing support block 228. The bearing support block 228 is mounted in a central bore 224 formed in the upper end 112 of the turn post carrier 35. A flange 230 is formed on the lower end of the bearing race support sleeve 229 and it supports the inner races of the bearings 227. A retainer collar 231 is threadably mounted on the upper end of the support sleeve 229 for drawing the inner races of the bearings 227 into supporting engagement with the bottom face of the bottom wall 226 on the driven drum body 225. The bearing race support sleeve 229 is further connected to the driven drum bottom wall 226 by a suitable key 233. The outer races of the bearings 227 are fixed in place on the bearing support block 228 by a suitable retainer ring 234 which is secured in place at the top of the block 228 by suitable machine screws 235, as shown in FIG. 3. The block 228 is fixedly secured to the turn post carrier 35, in the central bore 224 by a plurality of suitable machine screws **228*a*, as shown in FIG. 3. As shown in FIGS. 1 and 2, a suitable cover plate 232 is mounted around the body 225 of the driven drum 215, and it is secured in place to the top of the turn post carrier 35 by suitable machine screws 232*a*, (FIG. 10**).

As shown in FIGS. 1 and 2, a driven pulley 238 is integrally formed on the lower outer end of the driven drum body 225. A drive belt 237 is operatively mounted around the pulley 238, and it is driven by a drive pulley 239, as shown in FIG. 2. The drive pulley or sheave 239 is fixedly mounted on the upper end of the drive shaft 240. The pulley 239 is fixed with suitable key means and by a pair of spacer washers 250, and a lock nut 251 on the upper end of the shaft 240. The lowermost washer 250 is seated on the inner race of a suitable ball bearing means 241 that is operatively mounted in the upper end of a bearing sleeve carrier 242. The bearing sleeve carrier 242 is mounted in a rearward housing extension on the upper end 112 of the turn post carrier 35, and it is secured in place in a bore 244 by a plurality of suitable machine screws 243. The bearing sleeve carrier 242 also carries a lower ball bearing means, generally indicated by the numeral 246, which supports the lower end of the shaft 240. Fixedly mounted on the shaft 240 between the upper bearing means 241 and the lower bearing means 242 is a driven wheel or gear 247 which is driven by worm gear 248 that is mounted on a shaft 249.

As shown in FIG. 3, the shaft 249 is mounted in a horizontal bore 252 in the turn post carrier extension 245. One end of the shaft 249 is operatively supported by a suitable ball bearing means 253 which is mounted in one end of the bore 252 and secured therein by a suitable retainer plate 254 that is held in place by a plurality of machine screws 255. The shaft 249 is supported at an intermediate point by a suitable ball bearing means 256, at the other end of the bore 252, and it is retained in place by a retainer plate 257 and machine screws 258. The front end of the shaft 249 extends outwardly of the turn post carrier extension 245, and it has fixedly mounted thereon a driven pulley or sheave 259 by a suitable set screw 264 and a pair of keys 265. The driven pulley 259 is driven by a drive belt 260 which is driven by a drive pulley or sheave 261 that is fixed by suitable means to the output shaft 262 of a suitable reversible D.C. drive motor, generally indicated by the numeral 263.

As shown in FIG. 2, the electric drive motor 263 is operatively mounted on a mounting bracket 268 which is fixed to a horizontal mounting plate 267 that is secured by suitable machine screws 270 to a horizontal mounting plate 269. As shown in FIG. 3, the horizontal mounting plate 269 is secured, as by welding, to a vertical mounting plate 271 which is fixed by a pair of machine screws 272 to the outer side of the turn post carrier extension 245. It will be seen from the aforegoing, that the drive means for the turn post 34 is carrier on the upper end 112 of the turn post carrier 35. It will also be seen that the bearings 227 support the forces originating in the drive belt 237 and the hereinafter described cam means 312 and 313. The bearings 227 isolate the turn post 34 from these forces, thereby improving the accuracy of the form dressed on a grinding wheel 12.

The shaft 249 may be manually turned by a hand wheel 299 which is provided with a handle 300, as shown in FIG. 3. The wheel 299 is retained on the outer end of the shaft 249 by a washer 297 and a machine screw 298. The wheel 299 is slidably mounted on the shaft 249 and is normally biased to an inactive position, as shown in FIG. 3, by a spring 296. The inner end of the wheel 299 is provided with a clutch member 295, and a similar clutch member 295 is integrally formed with the pulley 259, whereby when an inward pressure is exerted on the wheel 299, the clutch members 295 will be engaged and the shaft 249 may be rotated manually. The wheel 299 should not be turned beyond a 90° manual rotation, and it is used for set-up and other purposes.

As illustrated in FIGS. 2, 3, 4 and 14, the side diamond means 14 and 15, for dressing the sides of a grinding wheel 12, are driven from a pinion gear 277 which is integrally formed on the upper end 208 of the turn post 34. It will be understood that the mounting and drive structure for each of the side diamonds 14 and 15 is the same, and the details of only one of these mounting and drive structures have been shown in FIG. 2 for side diamond 15, and the same structure is used for the side diamond 14. The pinion 277 meshes with and drives a pair of diametrically disposed gear sectors 278 which are each integrally formed on a hub 273 that is fixed by a key 274 (FIG. 2) to the upper end 279 of a side diamond shaft, generally indicated by the numeral 281. The gear sector hub 273 is secured on the shaft portion 279 by a suitable lock nut 280.

As shown in FIG. 2, the hub 273 is seated on the upper side of a suitable circular retainer member 275, which in turn is seated on a washer 276. The washer 276 is seated on the inner race of an upper tapered roller bearing means, generally indicated by the numeral 282. The outer race of the bearing means 282 is seated on a shoulder formed in a stepped bore 283 that is formed through the upper end 112 of the turn post carrier 35. The lower end of the side diamond shaft 281 is supported by a lower tapered roller bearing means, generally indicated by the numeral 284. A bearing race retainer sleeve 285 is disposed in the bore 283, and its lower end engages the outer race of the bearing means 284. The retainer sleeve 285 is secured in position by a suitable machine screw 286. The inner race of the bearing means 284 is secured in place by a hub 287 which carries the side diamond 15. The hub 287 has a slotted portion through which is mounted a suitable lock screw 288 for locking the hub 287 on the lower end of the shaft 281. The hub 287 is further locked in position by a suitable lock nut 289. A suitable seal 290 is mounted in the lower end of the bore 283. The hub 287 carries an offset diamond carrier arm 291 on which is mounted the side diamond 15. The carrier arm 291 is provided with a bore 292 which is disposed at a slight angle upwardly from the horizontal so that the point of the side diamond 15 points upwardly. The side diamond 15 comprises a conventional diamond bar 293 which is secured in an adjusted position in the bore 292 by a suitable set screw 309. The diamond bar 293 is adjusted axially in the bore 292 by a suitable adjustment screw means 294.

It will be understood that the main diamond means 13 may be employed without the use of the side diamond means 14 and 15. It will also be understood that only one of the side diamond means 14 or 15 may be used instead of two, if desired. The side diamond means 14 and 15 provide the additional function of reducing the thickness of a grinding wheel 12 during the time when the main diamond 13 is imparting a form, such as a radial form, to the periphery of a grinding wheel 12. This last described action is illustrated in FIGS. 14 through 17, wherein the main diamond 13 is shown in an initial or starting position in FIGS. 14 and 15, and the side diamonds 14 and 15 are shown in said Figures in the starting position. FIG. 16 shows the main diamond 13 in the middle position of a radial dressing operation, the side diamond 15 has performed its side dressing operation, and the side diamond 14 is moving into a side dressing operation. FIG. 17 shows the end of the combined radial and side dressing operations wherein the side diamond 14 has completed its dressing operation and the main diamond 13 has completed its radial dressing operation.

As shown in FIGS. 1 and 2, the driven drum 215 is provided with an elongated, annular slot 301 through which protrudes a stop lug, 302. As best seen in FIG. 1, the stop lug 302 is secured by a suitable machine screw 303 to the flange 202 of the turn disc 209. The stop lug 302 is normally maintained by the action of a wound-up spring 213 against the right side of the slot 301, as viewed in FIG. 2. As shown in FIGS. 2 and 10, a first dog 304 is adjustably secured by a machine screw 304*a* to the side of the driven drum 215 in a position above the slot 301. The dog 304 functions to engage a limit switch roller 305 which is carried on the outer end of a limit switch arm 306 for operating a limit switch 307 to control the reversing action of the electric motor 263. As shown in FIG. 10, a second limit switch dog 304' is also adjustably secured to the side of the driven drum 215 by means of a machine screw 304*a'*. The two limit switch dogs 304 and 304' determine the range of rotation of the driven drum 215, and consequently the angular movement of the main diamond 13.

As shown in FIGS. 2 and 10, a circular cam drum 310 is fixed on the upper end of the driven drum 215 by a plurality of machine screws 311. The cam drum 310 has operatively mounted thereon a circular cam 312 which has an outwardly extended cam lobe 320, as viewed in FIG. 4. As shown in FIGS. 2 and 4, the cam 312 is adapted to rollably engage the convex outer surface of a roller cam follower 313, which is rollably mounted by suitable means on the upper end of a vertical shaft 314 that is disposed adjacent the driven drum 215. The shaft 314 is retained in a suitable bore in the horizontal bracket arm 315 by a set screw 308. The bracket arm 315 is integrally attached to a vertical bracket arm 316 which is integrally attached at its lower end to a horizontal bracket arm 317. The bracket arm 317 is fixed by a plurality of machine screws 318 to the upper side of the carrier frame member 120*a*. The bracket arms 315, 316 and 317 comprise what may be termed a pivot bracket 319. As shown in FIG. 4, a stop dog 324 is fixedly mounted, by any suitable means, on the upper face of the turn post carrier plate 232, and it carries an adjustable stop screw 323. The stop lug 302 is shown in FIG. 4 as being in a position where it has engaged the stop screw 323 at a point in the dressing operation, as explained more fully hereinafter. The numeral 327 in FIG. 4 generally designates a grinding wheel guard plate assembly that is operatively mounted over the grinding wheel position during a dressing operation.

Operation

In operation, the dresser unit 10 requires only one prime mover, namely the reversible D.C. electric drive motor 263 to accomplish all functions, including the automatic retraction of the main diamonds 13 at the end of a truing or forming path, and the automatic extension of the main diamond 13 at the end of the return path. The dresser unit 10 is a multifunction dresser and it is adapted to impart to a grinding wheel either a combination radial and straight form, a radial form, a straight form, or a Gothic Arch form.

In carrying out an automatic combination radial and straight form dressing operation, only one of the side diamonds 14 and 15 is preferably employed. Usually, the side diamond nearest the circular portion is not used since it may contact the just formed circular portion during the forming of the straight portion. When forming a combination radial and straight line form of the type shown in FIG. 2A of the aforementioned Barnard U.S. Pat. No. 3,167,064, the driven drum 215 would be driven counterclockwise, as viewed in FIGS. 4 and 10. The wound-up clock spring 213 forces the stop lug 302 against the forward end or right end of the slot 301 as viewed in FIG. 12, so that the turn disc 209 moves in unison with the driven disc 215 so as to drive the main diamond 13 from an initial position adjacent the bumper screw 202 (FIG. 5) and in a radial path. When the driven disc 215 is moved counterclockwise to the position shown in FIG. 10, the stop lug 302 will engage the stop screw 323. This action terminates the radial dressing action and stops the turn disc 209, but the driven disc 215 continues to rotate the spring 213, whereby the slot 301 permits the driven drum 215 to continue counterclockwise rotation relative to the stop lug 302. When the stop lug 302 is in the position shown in FIG. 10, the main diamond 13 is in the position shown in FIG. 5, the motor 263 continues rotating for a small time interval, and the diamond 13 travels in a straight line due to the swinging action caused by the cam lobe 320 pushing against the cam follower roller 313 and swinging the turn post carrier 35 in a snap-angle action, counterclockwise direction, as viewed in FIG. 2, about the tapered trunnion bearings 118.

The combined rotary and swinging movements of the turn post carrier 35 cause the diamond 13 to travel on a straight dressing path which falls within a vertical plane perpendicular to the plane of grinding wheel 12. The turnpost carrier 35 lying in a vertical plane in turn is adjustable from a position parallel to the grinding wheel 12 to a spatial or non-parallel position that is at some angle (shown in FIG. 2) to the parallel plane of the grinding wheel as described below. By adjusting the post stop screw 323 and the amount of the cam height of lobe 312, and by rotatably adjusting the turn post carrier frame, the snap-angle or loading-angle can be adjusted. The lower end of the turn post carrier 35 swings away from the set screws 52 and 53 during the snap-angle action, the reversal of motor 263 allows the spring 60 to return the turn post carrier 35 to the position shown in FIG. 7 before the main diamond 13 has been returned to its initial position against the bumper screw 202. The diamond 13 is moved in the reverse position after the straight line travel at a faster rate than when it is rotating forward, since the forward dressing operation must be carried out at a very slow rate of movement. When the motor 263 has returned the diamond back to its initial position, the flange 164 engages the bumper screw 202 to extend the diamond 13 to its initial position ready for another dressing operation. The motor 263 is reversed by the action of the limit switch dog 304 tripping the limit switch 307.

Gothic Arch Form

Figure 11:
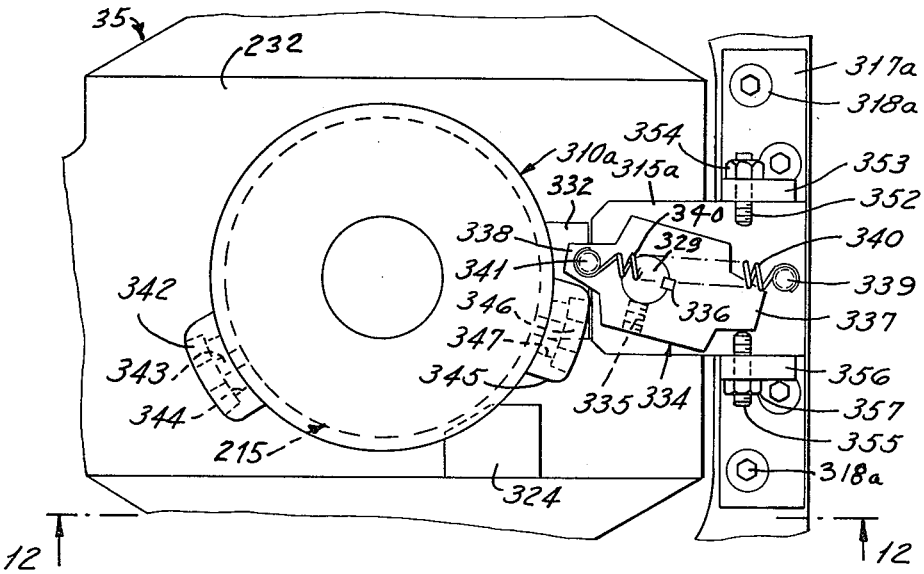
FIG. 11 is a fragmentary, top plan view, similar to FIG. 4 of a modified grinding wheel truing mechanism made in accordance with the principles of the present invention, and adapted to dress a Gothic Arch form.
Figure 12:
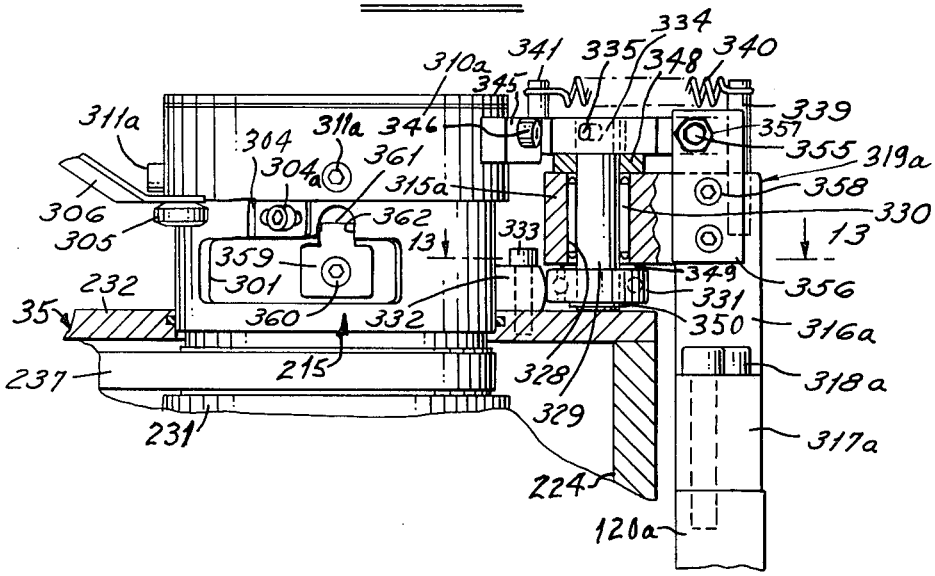
FIG. 12 is a fragmentary, side elevation view of the structure illustrated in FIG. 11, taken along the line 12—12 thereof, and looking in the direction of the arrows.
Figure 13:
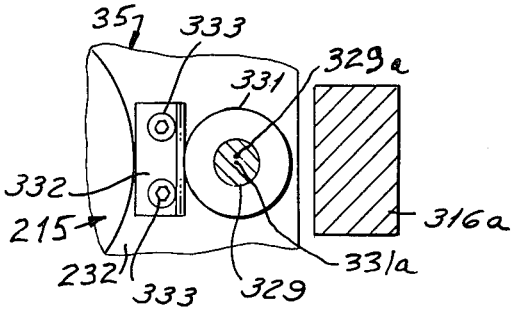
FIG. 13 is a fragmentary, horizontal section view of the structure illustrated in FIG. 12, taken along the line 13—13 thereof, and looking in the direction of the arrows.
Figure 18:
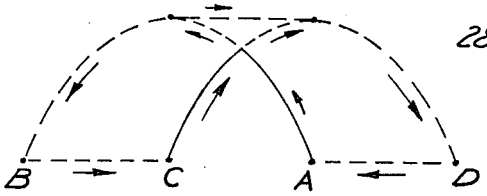
FIG. 18 is a schematic view showing the path of travel of the main diamond when it is dressing a typical Gothic Arch form of a grinding wheel.

The dresser unit 10 of the present invention may be employed for dressing a Gothic Arch form, such as that illustrated in FIG. 18, by merely removing the cam drum 310 and the cam follower 313 and its assembly, and replacing such structure with a Gothic Arch attachment as illustrated in FIGS. 11, 12 and 13. As shown in FIG. 12, the Gothic Arch attachment structure includes a pivot bracket structure 319*a*, and the parts thereof which are similar to the pivot bracket 319 are marked with the same reference numerals followed by the small letter "*a*".

The horizontal bracket arm portion 315*a* is provided with a vertical bore 328 in which is rotatably mounted a vertical pivot shaft 329 by a suitable roller bearing means 330. An offset roller cam follower 331 is mounted on the lower end of the pivot shaft 329, in a position whereby its axis of rotation 331*a* is offset approximately 0.002 inch laterally from an axis passing through the axis of rotation of the turn post 34 and the axis of rotation 329*a* of the pivot shaft 329. A cam 332 is fixedly mounted on the upper side of the post carrier plate 232 by suitable machine screws 333 in a position engaging the offset roller cam follower 331, as shown in FIG. 13. As shown in FIGS. 11 and 12, a pivot plate or toggle, generally indicated by the numeral 334, is fixed by a set screw 335 and a key 336 on the upper end of the pivot shaft 329. An outer toggle arm 337 is integrally formed on the outer end of the toggle 324, and an inner toggle arm 338 is formed on the inner end thereof. A dowel pin 339 is fixed on the upper end of the pivot bracket 319*a,* and it secures one end of a spring 340. The other end of the spring 340 is secured by a dowel pin 341 to the inner toggle arm 338. A first adjustable stop 342 is secured by a machine screw 343 to the outer face of the cam drum 310*a.* A machine screw 343 passes through an elongated slot 344 in the stop 342 to permit angular adjustment about the periphery of the cam drum 310*a.* A second adjustable stop 345 is positioned on the periphery of the cam drum 310*a,* and it is secured by a machine 346 that passes through an elongated slot 347 in the stop 345. The elongated slot 347 permits sideward adjustment of the stop 345. A spacer washer 348 is mounted between the toggle 334 and the support bracket arm 315*a.* A spacer washer 349 is mounted between the lower end of the support bracket arm 315*a* and the upper face of the offset roller cam follower 331. A retainer clip 350 retains the offset roller cam follower 331 on the pivot shaft 329.

As shown in FIG. 11, the pivoting travel of the toggle 334 is limited in one direction by an adjustable stop screw 352 and in the other direction by an adjustable stop screw 355. The stop screw 352 is fixed in an adjusted position in a mounting plate 353 by a lock nut 354. The stop screw 355 is fixed in a mounting plate 356 by a lock nut 357. The mounting plates 353 and 356 are secured to the vertical bracket arm 316*a* by suitable machine screws 358.

In the use of the Gothic Arm form attachment structure, the clock spring 213 is disabled, or made inactive, by replacing the stop lug 302 with a key 359 which is secured to the turn disc flange 212 by a suitable machine screw 360. The key 359 is provided with an integral upwardly extended key finger 361 which is seated in the vertical slot 362 formed in the driven drum 215, whereby the turn disc 209 is secured to the driven disc 215 for positive drive therewith. The pivot plate or toggle 334 may also be called a spring loaded flip flop means, and the offset roller cam follower 331 may also be termed an eccentric follower.

In dressing a Gothic Arch form, as shown in FIG. 18 with the last described Gothic Arch attachment structure, the rear side diamond 14 is normally removed. The toggle 334 would be in a position with the outer toggle arm 337 positioned against the stop screw 352, and it would have been moved in that position by the adjustable stop 342. The turn post carrier 35 would be in the initial position, reference FIG. 7, but it is held against the screws 68 and 69. Upon energizing, the drive motor 263, the driven drum 215 would be driven in a counter-clockwise direction, as shown in FIG. 11, and the main diamond 13 would dress the first half of the Gothic Arch shown in FIG. 18, that is, it would move from point "A" to point "B". When the diamond 13 reaches point B, the adjustable stop 345 then cams the toggle 334 to the position shown in FIG. 11, whereby the eccentric cam 331 allows the spring 60 to pull the turn post carrier 35 about the trunnion bearings 118 to swing the lower end of the turn post carrier 35 against the screws 52 and 53, as shown in FIG. 7. This motion brings the diamond from point B to point C as shown in FIG. 18. The limit switch dogs are positioned so that the drive motor 263 is then energized to reverse the driven drum 215, and the main diamond 13 would dress the second half of the Gothic Arch as it would move from point "C" to point "D" as shown in FIG. 18.

When the diamond 13 reaches the point "D", the motor 263 is de-energized and stops as the stop 342 resets the toggle 334 against the stop screw 352, whereby the eccentric cam 331 shown in FIG. 12 pushes the turn-post carrier 35 shown in FIG. 1 about the trunnion bearings 118 to swing the lower end of the turn post carrier 35 against the screws 68 and 69, reference FIG. 7, which brings the main diamond 13 back to position "A" as shown in FIG. 18, and the dresser unit is in a position for another dressing cycle. It will be understood that the limit switch dogs 304 and 304' will be disposed on the driven drum 215 to carry out the desired and proper reversing of the motor 263 at the appropriate times.

It will be seen that various Gothic Arch forms can be dressed with the dressing unit 10. In dressing a Gothic Arch form, the main diamond 13 follows a path consisting of two circular arcs which are joined by a straight line segment as shown in FIG. 18. The straight line movement is effected by the eccentric follower 331, and the exact length of the straight line movement is determined by the two set screws 352 and 355. The eccentricity of the eccentric follower 331 and the position of the stop screws 352 and 355 are employed for controlling the severity of any Gothic Arch form. The actual amount of travel is determined by adjusting the screws 68 and 69 as shown in FIG. 7.

Figure 15:
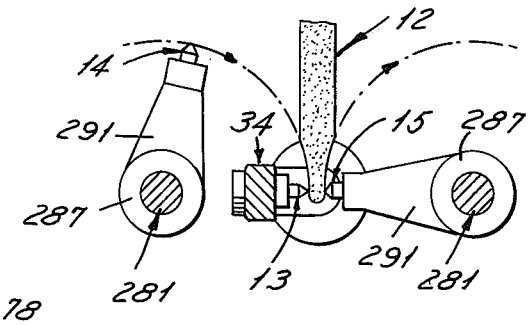
FIG. 15 is a schematic view of the structure illustrated in FIG. 14, and showing the position of the three diamonds at the beginning of a dressing cycle.
Figure 14:
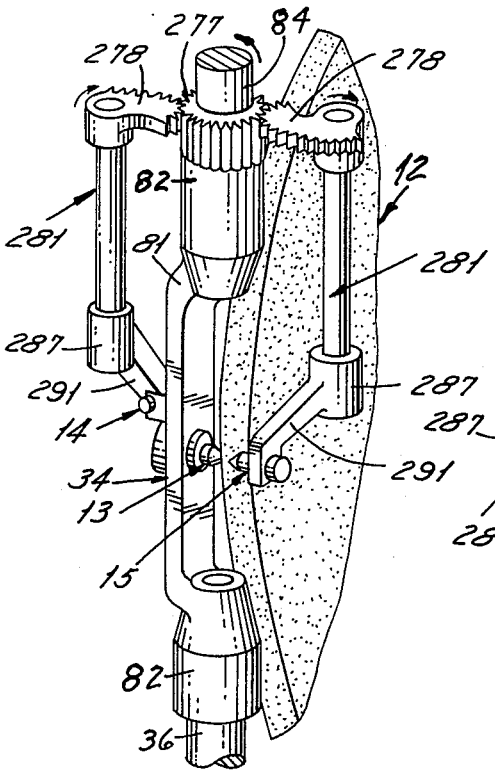
FIG. 14 is a fragmentary, elevational perspective view showing two side wheel dressing diamonds and a single radial dressing diamond employed in the grinding wheel truing mechanism of the present invention.
Figure 16:
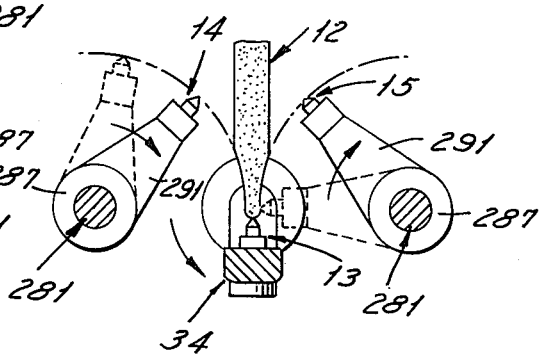
FIG. 16 is a view similar to FIG. 15, showing the three diamonds moved to the middle position in a dress cycle.
Figure 17:
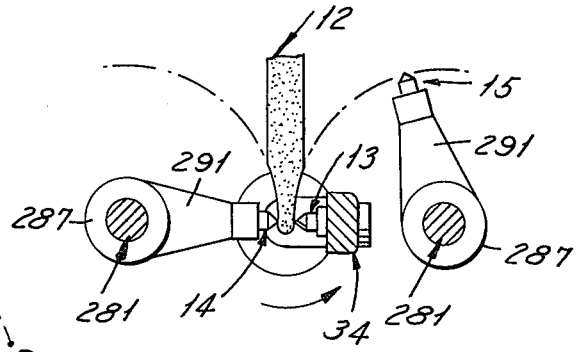
FIG. 17 is a view similar to FIGS. 15 and 16, showing the three diamonds moved to the end position in a dress cycle.

It will be seen that by the use of the key 359 for disabling the clock spring 213 and deleting the cam 312, and by disposing the limit switch control dogs in the appropriate places, the dresser unit 10 may be employed for dressing a radial form of 180°, as shown in FIGS. 15 through 17. It will also be understood that for a 180° rotation of the diamond 13, the bumper screw 194 is relocated to permit such travel, which is the maximum travel of the main diamond 13.

While it will be apparent that the preferred embodiments of the invention herein disclosed are well calculated to fulfill the objects above stated, it will be appreciated that the invention is susceptible to modification, variation and change.

What is claimed is:

1. In a grinding wheel truing mechanism for dressing forms on the periphery of a grinding wheel, the combination comprising:

A. a support housing for mounting in a position adjacent a grinding wheel on which a form is to be imparted to the periphery of the grinding wheel;

B. a turn post carrier having one end pivotally mounted on said housing;

C. means for normally biasing the other end of said turn post carrier to an initial position;

D. a turn post rotatably mounted on said turn post carrier, said means for rotating said turn post includes:
1. a reversible power drive means mounted on said turn post carrier;
2. a drive system connecting said power drive means with said turn post for rotating the turn post; said drive system includes:
a. a driven drum rotatably mounted on said turn post carrier and connected to said turn post;
b. means connecting said reversible power drive means to said driven drum for driving the same in a selected direction of rotation;

E. a main diamond mounted on said turn post for dressing form on the periphery of a grinding wheel;

F. means for rotating said turn post and swinging said turn post carrier from said initial position for advancing said main diamond from an initial position through a dressing path for dressing a form on the periphery of a grinding wheel, and for retracting the main diamond to said initial position, said means for swinging said turn post carrier includes:
1. a cam means for swinging said turn post carrier from said initial position to a second position after a dressing action through a first arcuate path by the main diamond for allowing the main diamond to dress a second arcuate path so as to form a Gothic Arch form on the periphery of a grinding wheel, said cam means for swinging said turn post carrier includes:
a. a fixed cam mounted on said turn post carrier;
b. an eccentric cam roller follower rotatably mounted on said support housing;
c. means for rotating said eccentric cam roller follower from a first position when the main diamond is moved through said first arcuate path to a second position when said main diamond is moved through said second arcuate path, said means for rotating said eccentric cam roller follower includes:
i. a toggle member for rotating said eccentric cam roller follower between said first and second positions; and,
ii. a pair of stop members mounted on the driven drum for moving the toggle member for rotating said eccentric cam roller follower.

2. A grinding wheel truing mechanism as defined in claim 1, wherein:
a. said driven drum is connected to said turn post by a clock spring means; and,
b. a key means for disabling the clock spring means to provide a direct driving action by the driven drum to the turn post.

3. In a grinding wheel truing mechanism for dressing forms on the periphery of a grinding wheel, the combination comprising:
A. a support housing for mounting in a position adjacent a grinding wheel on which a form is to be imparted to the periphery of the grinding wheel;
B. a turn post carrier having one end pivotally mounted on said housing;
C. means for normally biasing the other end of said turn post carrier to an initial position;
D. a turn post rotatably mounted on said turn post carrier;
E. a main diamond mounted on said turn post for dressing forms on the periphery of a grinding wheel;
F. means for rotating said turn post and swinging said turn post carrier from said initial position for advancing said main diamond from an initial position through a dressing path for dressing a form on the periphery of a grinding wheel, and for retracting the main diamond to said initial position;
G. means for mounting the main diamond on said turn post,
H. means for retracting the main diamond relative to said turn post when said main diamond is at the end of each dressing path and for extending the diamond after it has been returned to the start of a dressing path and means mounted at said end of said dressing path to actuate said retracting means.

4. In a grinding wheel truing mechanism for dressing forms on the periphery of a grinding wheel, the combination comprising:
A. a support housing for mounting in a position adjacent a grinding wheel on which a form is to be imparted to the periphery of the grinding wheel;
B. a turn post carrier having one end pivotally mounted on said housing;
C. means for normally biasing the other end of said turn post carrier to an initial position;
D. a turn post rotatably mounted on said turn post carrier;
E. means for rotating said turn post and swinging said turn post carrier from said initial position for advancing said main diamond from an initial position through a dressing path for dressing a form on the periphery of a grinding wheel, and for retracting the main diamond to said initial position;
F. a main diamond mounted on said turn post for dressing forms on the periphery of a grinding wheel; said means for mounting the main diamond includes:
1. a diamond holder housing rotatably mounted on said turn post for retraction in one direction and extension in another direction;
2. means for adjustably mounting said main diamond in said diamond holder housing;
3. means for rotating said diamond holder housing in said one direction for retracting the main diamond at the end of a dressing path and for extending said main diamond when it is returned to the start of a dressing path, said means for rotating said diamond holder housing includes:
a. a first detent means for holding said diamond holder housing in a first position with the main diamond in an extended position;
b. a second detent means for holding said diamond housing in a second position with the main diamond in a retracted position; and,
c. bumper stop means mounted on said support housing for engaging the diamond holder housing at the ends of a dressing path for rotating said diamond holder housing between said positions.

* * * * *